US005264801A

United States Patent [19]

DeCou, Jr. et al.

[11] Patent Number: 5,264,801

[45] Date of Patent: Nov. 23, 1993

[54] ACTIVE CARBON BARRIER FOR X-RAY TUBE TARGETS

[75] Inventors: Donald Frank DeCou, Jr., Naperville; James G. Hull, Brookfield, both of Ill.

[73] Assignee: Picker International, Inc., Highland Hts., Ohio

[21] Appl. No.: 878,747

[22] Filed: May 5, 1992

[51] Int. Cl.[5] ..... H01J 35/08

[52] U.S. Cl. ..... 378/129; 378/127; 378/143

[58] Field of Search ..... 378/119, 127, 129, 143, 378/144

[56] References Cited

U.S. PATENT DOCUMENTS 4,090,103 5/1978 Machenschalk et al. ..... 378/129
5,157,706 10/1992 Hohenauer ..... 378/129
5,159,619 10/1992 Benz et al. ..... 378/129

*Primary Examiner*—David P. Porta

*Attorney, Agent, or Firm*—Fay, Sharpe, Beall, Fagan, Minnich & McKee

[57] ABSTRACT

A target track (20) of an anode (14) of an x-ray tube becomes heated adjacent a focal spot (18) to temperatures on the order of 1100°-1400° C. To protect the anode, a body portion (34) is coated (46) with a thermal energy emissive oxide layer (48). In order to prevent carbon from the body portion from migrating out to the oxide layer and forming carbon monoxide gas, a carbide forming barrier layer (36) is formed (38,40) between the body and the oxide coating. The barrier layer is a dense, substantially pore-free coating of a metal that has a free energy of carbide formation of at least 100 KJ/mole at 1200° C. Preferably, the barrier layer material is zirconium, although hafnium, titanium, vanadium, uranium, tantalum, niobium, chromium, and their alloys also provide acceptable barriers to carbon atom migration. A molybdenum layer (44) is disposed (42) between the oxide layer and the barrier layer to prevent the zirconium or other of the above-listed barrier materials from interacting detrimentally with constituents of the oxide layer.

23 Claims, 2 Drawing Sheets

ACTIVE CARBON BARRIER FOR X-RAY TUBE TARGETS

BACKGROUND OF THE INVENTION

The present invention relates to the vacuum tube arts. It finds particular application in conjunction with high power, rotating anode x-ray tubes and will be described with particular reference thereto. It is to be appreciated, however, that the invention will find application in conjunction with other types of x-ray tubes and tubes in which high temperature target operation causes a carbon monoxide outgassing problems.

Heretofore, x-ray tubes have included an evacuated envelope which held a cathode and an anode. The anode included a composite target with tungsten tracks into a backing material. Electrons emitted by a cathode filament were drawn to a target area of the anode by a high voltage. The impact of the electron beam on the anode target causes high heating and the emission of x-rays. To dissipate the heat, means were provided for rotating the anode. As the anode rotated, each spot on the tungsten track that was heated by the electron beam rotated about 360° before again receiving the electron beam. This worked well for low dissipation targets, particularly at temperatures below 1000° C. However, as target temperatures were increased into the range of 1100°-1400° C. for higher performance, additional measures were required to prevent thermal damage.

To increase thermal power dissipation, the anode bodies were partially coated with a thermally emissive oxide layer. Typical oxides include aluminum titania oxide, in which the titanium dioxide is oxygen deficient resulting in very black coating.

Although the oxides are effective for dissipating the heat energy, the small amount of carbon in the titanium zirconium molybdenum (TZM) composite anode body tends to migrate to the surface, reacting with the oxide and forming carbon monoxide gas. The escape of carbon monoxide into the vacuum space of the tube destroys the vacuum. Although the anode composite typically contains only about 100 parts per million of carbon, when heated to the 1100°-1400° C. range, sufficient carbon monoxide is generated to reduce tube life through vacuum degradation. Even with the fastest gettering available with current technology, the carbon dioxide pressure becomes sufficiently high that it causes instability, sputtering of materials, crazing and even puncture of the glass envelope.

One proposed solution was to apply a 20-80 zirconium molybdenum alloy with a low pressure plasma spray to the anode body before applying the oxide coating. The plasma sprayed alloy contained about 15%-20% zirconium and 80%-85% molybdenum. Although this layer appears to reduce carbon monoxide emissions when the tube is new, it quickly becomes ineffective. The rate of carbon monoxide emission soon becomes the same with the plasma sprayed zirconium molybdenum alloy layer as without.

The present invention contemplates a new and improved anode construction which overcomes the abovereferenced problems and others.

SUMMARY OF THE INVENTION

In accordance with the present invention, an anode body of an x-ray tube is at least partially coated with a material that forms stable carbides. The carbide forming layer is coated with thermally emissive oxide for dissipating heat. Any carbon migrating from the anode body forms a carbide that is sufficiently stable that the carbon does not react with oxygen in the oxide coating to form carbon monoxide.

In accordance with another aspect of the present invention, a buffer layer is applied between the carbide forming layer and the oxide layer to insure capability.

In accordance with a more limited aspect of the present invention, the carbide forming layer is a material from the group consisting of zirconium, hafnium, tantalum, vanadium, titanium, uranium, niobium, chromium, and alloys thereof.

In accordance with more limited aspect of the present invention, the carbide forming layer is substantially pure zirconium.

In accordance with a more limited aspect of the present invention, a porous zirconium coating is heated close to its melting point to form a dense, substantially pore-free zirconium layer on the anode body.

In accordance with another more limited aspect of the present invention, the buffer layer includes molybdenum or other materials with which the oxide is stable to prevent infiltration of zirconium or other group IVB materials of the carbide forming layer from interacting with the oxide causing titanium in the oxide coating to be released in gaseous form.

A primary advantage of the present invention is that it extends tube life.

Another advantage of the present invention is that it prevents carbon monoxide formation.

Another advantage of the present invention is that is compatible with other anode materials.

Yet another advantage of the present invention is that it provides for an anode which operates at temperatures above 1100° C. with a long tube life.

Still further advantages of the present invention will become apparent to those of ordinary skill in the art upon reading and understanding the following detailed description of the preferred embodiment.

BRIEF DESCRIPTION OF THE DRAWINGS

The invention may take form in various components and combination of components, and in various steps and combinations of steps. The drawings are only for purposes of illustrating a preferred embodiment and are not to be construed as limiting the invention.

DETAILED DESCRIPTION OF THE PREFERRED EMBODIMENT

Figure 1A:
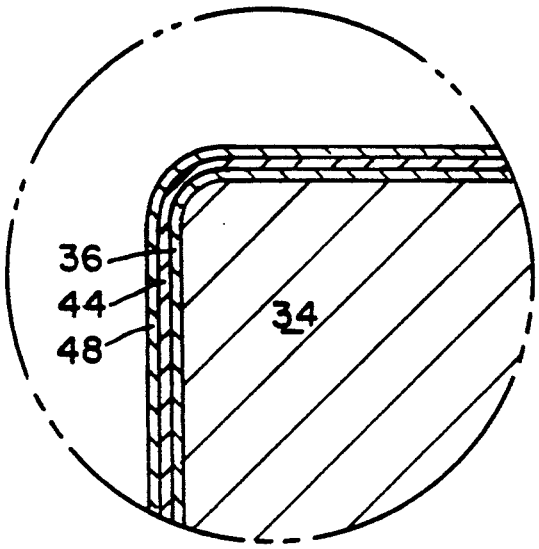
FIG. 1A is an enlargement of a portion of the anode surface for clearer illustration of its coating layers; and, FIG. 2 is a diagrammatic illustration of a preferred coating process.
Figure 1:
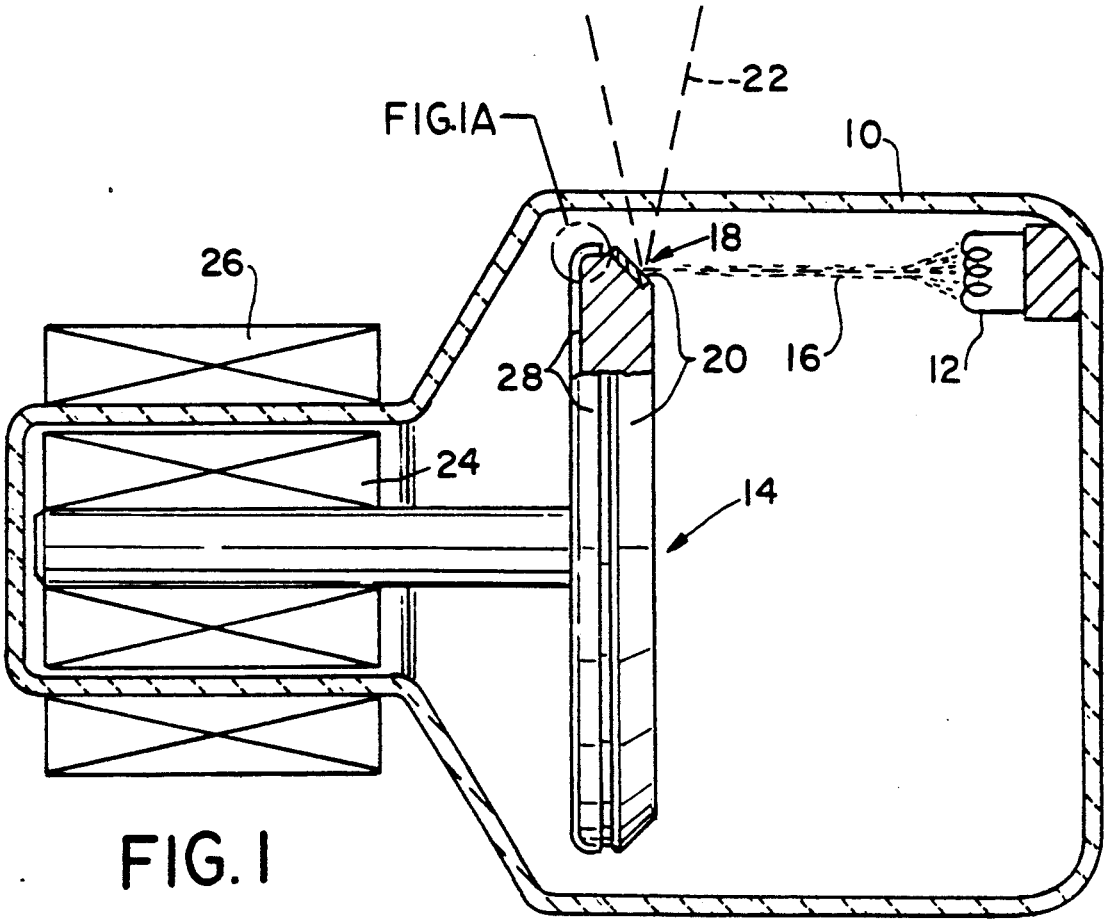
FIG. 1 is a diagrammatic illustration of an x-ray tube in partial section.

An x-ray tube includes an envelope 10, typically a glass envelope, within which a vacuum is defined. A cathode filament 12 disposed within the envelope generates a cloud of electrons. When a high DC potential is applied between the cathode filament and an anode target 14, an electron beam 16 impacts a focal spot 18 on a tungsten track 20 of the target causing the generation of an x-ray beam 22. Typically, the anode is mounted to a rotor 24 disposed within the housing. Stator windings 26 on the exterior of the housing control rotation of the rotor and the target.

The electrical potential applied between the filament and the target to generate high energy x-rays, in the preferred embodiment, causes the electrons to impact the target track 20 anode with such energy, the target 14 becomes heated to the range of 1100°-1400° C. A thermally emissive coating 28 on the sides and face of the target away from the cathode irradiate thermal energy from the target across the vacuum to the exterior of the housing.

Figure 2:
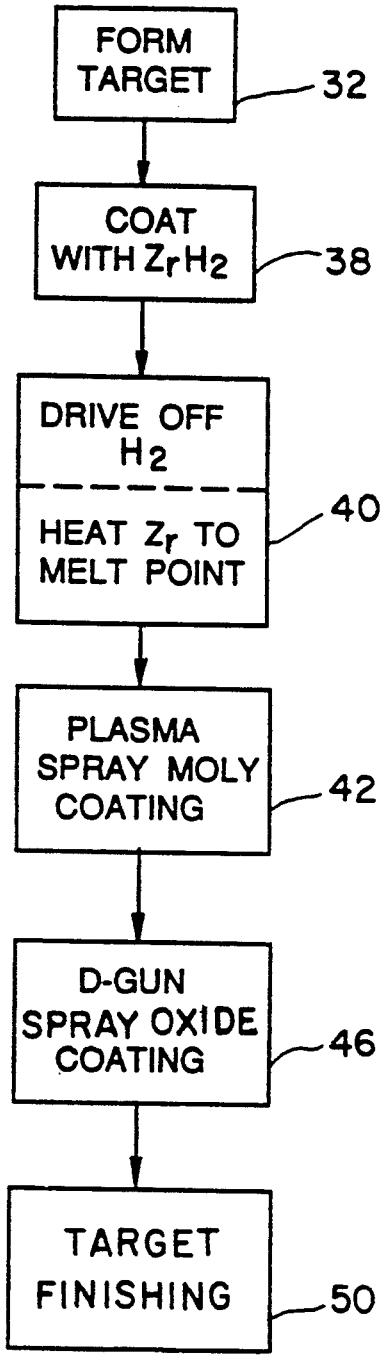

With particular reference to FIG. 1A and further reference to FIG. 2, the target 14 is forged in a step 32. A tungsten powder is placed in a mold along the region that defines the target track 20. Titanium zirconium molybdenum powder, which contains about 400 ppm carbon for structural strength is placed over the tungsten powder to define a body portion 34. The mold and powdered materials are fired to sinter it. The sintered target is forged at a high temperature into the composite target 14. The side surfaces below the tungsten track and the back surface are machined smooth in preparation for the thermally emissive coating 28. Alternately, the anode target track surface may be plated, laminated, deposited, sprayed, or otherwise formed on the target body. To form the emissive coating 28, the machine surfaces of the target body are first coated with a layer 36 of a material that forms stable carbides. The material is selected such that the carbon migrating from the target body 34 has a greater affinity for the carbide forming material than for oxygen to form carbon monoxide at the operating temperature of the tube. A material with a free energy of carbide formation of 100 KJ/mole at 1200° C. would limit carbon monoxide gas generation from the target to below $10^{-9}$ Torr, an acceptable amount of gas. More specifically to the preferred embodiment, in a coating step 38, finely divided powdered zirconium hydride in an alcohol slurry is sprayed on the lower surfaces of the target body 34. In a vacuum heating step 40, the powder coated target is heated in a vacuum oven. At about 300 ° C., the hydrogen is driven-off, leaving a coating of zirconium powder. The zirconium is further heated to about 1500°-1750° C. More specifically, partially coated target is heated to a sufficiently high temperature that the carbide forming material softens and flows over the surface forming a dense, substantially pore-free layer 36 of high zirconium concentration. Preferably, the carbide forming barrier layer is in the range of 0.001 to 0.002 inches thick.

In a buffer coating step 42, a layer 44 of a buffer material is formed over the carbide forming layer 36 to assure compatibility between the carbide forming layer and subsequent layers. In the preferred embodiment, a 0.005 inch thick layer of substantially pure molybdenum is sprayed onto the zirconium molybdenum eutectic layer using a conventional plasma spray process.

In an oxide coating step 46, an oxide or other thermally emissive coating 48 is applied on the buffer layer. In the preferred embodiment, the oxide coating is alumina titania oxide that is sprayed about 0.002 inches thick using a conventional D-gun spraying process.

In a target finishing step 50, the annular target track 20 is machined smooth and true. The machining removes any zirconium, molybdenum oxide or other materials that may have covered the track 20. The upper surface of the target may also be machined smooth.

Numerous alternate embodiments are also contemplated. For example, the coating step 38 may incorporate sputtering, low-pressure plasma spray, physical vapor deposition, ion plating, and other techniques that provide a dense, coherent, substantially pore-free coating of a high zirconium concentration either directly or with annealing near the melting point of the zirconium.

A hard molybdenum zirconium intermetallic compound ($Zr\ Mo_2$) is formed with molybdenum leaching from the body 34 and with the molybdenum buffer layer 44. The intermetallic compound is sufficiently hard and brittle that it tends to fracture if the two intermetallic interfaces meet. To inhibit fracturing, the zirconium layer is sufficiently thick that zirconium separates the intermetallic interfaces.

The zirconium layer is applied with sufficient thickness that there is sufficient zirconium available to form zirconium carbide with substantially all the carbon that may seek to migrate from the body 34 to the oxide layer 48. Yet, the zirconium layer is sufficiently thin that its different expansion and contraction coefficients relative to the TZM target body alloy and the other coatings and its undergoing a hexagonal to body centered cubic phase change about 800° C. does not cause delamination. Although pure zirconium is preferred, zirconium alloys may also be effective. Preferably, alloys of at least 70% zirconium are utilized to form the carbon barrier, although zirconium alloys with as little as 50% zirconium may be effective.

In addition to zirconium, other elements which form carbides which are sufficiently stable that the carbon is not released to form carbon monoxide within the operating temperatures of an x-ray tube are also contemplated. More specifically, the carbon barrier layer is a material which forms carbides with a free energy of carbide formation of at least 100 KJ/mole at 1200° C. Other group IVB metals such as titanium, hafnium, and their alloys also form sufficiently stable carbides. Although titanium and hafnium are effective, the zirconium is preferred. Although highly effective, hafnium is significantly more expensive than zirconium. Titanium tends to form a gas at high temperatures raising potential problems in keeping it from migrating to the surface. Other suitable stable carbide forming materials include vanadium, uranium, tantalum, niobium, chromium and their alloys. Due to their high melting points, it is more difficult to form a dense, coherent pore-free coating of uranium, tantalum, niobium, or chromium without thermally damaging the anode body. Nonetheless, the applicants contemplate carbide forming barrier layers that include zirconium, hafnium, vanadium, uranium, tantalum, niobium, chromium, titanium, and alloys thereof. Hafnium and tantalum are particularly desirable because their carbides are the most stable of the group. It is contemplated that these metals may be alloyed with each other and with other metals, such as molybdenum, to facilitate the coating process and compatibility with the target body and oxide coating.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. An x-ray tube comprising:

an envelope having an evacuated interior region;

a cathode disposed within the envelope vacuum interior; and an anode target disposed within the envelope vacuum region, the anode target having a target track which is impacted by electrons emanating from the cathode to generate x-rays, the anode target including:

body portion, an oxide layer for dissipating thermal energy from the target, a dense, substantially pore-free layer of a material that forms carbides with sufficient stability that carbon is not released from the carbide to form carbon monoxide gas at temperatures below about 1200° C., the stable carbide forming layer being between the body portion and the oxide coating.

2. The x-ray tube as set forth in claim 1 wherein the stable carbide forming material has a free energy of carbide formation over 100 KJ/mole at 1200° C.

3. The x-ray tube as set forth in claim 1 wherein the stable carbide forming material includes at least one of zirconium, hafnium, vanadium, uranium, tantalum, niobium, chromium, and alloys thereof.

4. The x-ray tube as set forth in claim 3 further including a buffer layer between the stable carbide forming layer and the oxide layer.

5. The x-ray tube as set forth in claim 1 wherein the stable carbide forming material includes at least one of zirconium, hafnium, and alloys thereof.

6. The x-ray tube as set forth in claim 5 further including a buffer layer between the stable carbide forming layer and the oxide layer.

7. The x-ray tube as set forth in claim 6 wherein the buffer layer is a layer of molybdenum.

8. An x-ray tube comprising:

an envelope having an evacuated interior region;

a cathode disposed within the envelope vacuum interior; and an anode target disposed within the envelope vacuum region, the anode target having a target track which is impacted by electrons emanating from the cathode to generate x-rays, the anode target including;

body portion, an oxide layer for dissipating thermal energy from the target, a layer which is at least 50 atom percent of a stable carbide forming material that includes at least one of titanium, zirconium, hafnium, vanadium, uranium, tantalum, niobium, chromium, and alloys thereof between the body portion and the oxide coating, the layer being sufficiently dense and pore-free that carbon migrating through the body portion form carbides with the dense pore-free layer, which carbides have sufficient stability that carbon is not released from the carbide to form carbon monoxide gas at temperatures below about 1200° C.

9. An anode for a high temperature x-ray tube, the anode comprising:

body portion;

an oxide layer for dissipating thermal energy;

a non-porous layer of a material that forms carbides with a free energy of carbide formation of at least 100 KJ/mole at 1200° C., the carbide forming layer being disposed between the body portion and the oxide layer to block carbon from migrating from the anode body and reacting with the oxide layer.

10. The anode as set forth in claim 9 wherein the carbide forming layer material includes at least one of titanium, zirconium, hafnium, vanadium, uranium, tantalum, niobium, chromium, and alloys thereof.

11. The anode as set forth in claim 9 wherein the carbide forming material includes at least one of zirconium, hafnium, and alloys thereof.

12. The anode as set forth in claim 11 further including a buffer layer between the carbide forming material and the oxide layer.

13. A method of forming an anode target for an x-ray tube, the method comprising:

forming a target body portion with a target track extending therearound;

coating at least a part of the body portion with a dense, substantially pore-free coating of a material that forms carbides with a free-energy of carbide formation of at least 100 KJ/mole at 1200° C.;

coating the carbide forming layer with an oxide.

14. The method as set forth in claim 13 wherein the carbide forming material includes at least one of titanium, zirconium, hafnium, vanadium, uranium, tantalum, niobium, chromium, and alloys thereof.

15. An anode target constructed according to the method of claim 13.

16. A method of forming an anode target for an x-ray tube, the method comprising:

forming a target body portion with a target track extending therearound;

applying a porous layer of the carbide forming material that forms carbides with a free-energy of carbide formation at least 100 KJ/mole at 1200° C. to the body portion;

heating the carbide forming material sufficiently near to the carbide forming material melting point that the carbide forming material flows into a dense and pore-free layer;

coating the carbide forming layer with an oxide, such that the dense, pore-free layer prevents carbon from the body portion from reaching the oxide to form carbon monoxide.

17. The method as set forth in claim 16 further including coating the carbide forming material with a buffer layer and wherein the oxide coating is applied over the buffer layer.

18. The method as set forth in claim 16 wherein the carbide forming material includes at least one of zirconium, hafnium, and alloys thereof.

19. The method as set forth in claim 18 further including applying a buffer layer on the carbide forming material before applying the oxide coating.

20. The method as set forth in claim 19 wherein the buffer layer includes molybdenum.

21. The method as set forth in claim 16 wherein in the heating step, the target body and coating are heated to less than 1750° C.

22. An anode for a high temperature x-ray tube, the anode comprising:

body portion;

an oxide layer for dissipating thermal energy;

a non-porous, hydrogen-free layer which is at least 50 percent of a material that forms carbides with a free energy of carbide formation of at least 100 KJ/mole at 1200° C., the carbide forming layer being disposed between the body portion and the oxide layer such that carbon is blocked from migrating out of the anode body and reacting with the oxide layer.

23. An x-ray tube comprising:

an envelope having an evacuated interior region;

a cathode disposed within the vacuum envelope; and an anode target disposed within the vacuum envelope, the anode target including:

a body portion;

a hydrogen-free barrier layer of a material that forms carbides with migrating free carbon at temperatures above 1100° C., a heat emissive layer for dissipating thermal energy.

* * * * *